US007341041B2

(12) United States Patent
Pekau

(10) Patent No.: US 7,341,041 B2
(45) Date of Patent: Mar. 11, 2008

(54) TOROIDAL ENGINE WITH VARIABLE DISPLACEMENT VOLUME

(75) Inventor: Rudolf R. Pekau, Calgary (CA)

(73) Assignee: VGT Technologies Inc., Calgary, Alberta (CA)

( * ) Notice: Subject to any disclaimer, the term of this patent is extended or adjusted under 35 U.S.C. 154(b) by 80 days.

(21) Appl. No.: 10/972,166

(22) Filed: Oct. 22, 2004

(65) Prior Publication Data

US 2006/0086336 A1 Apr. 27, 2006

(51) Int. Cl.

| | |
|---|---|
| ***F02B 53/10*** | (2006.01) |
| ***F02B 53/04*** | (2006.01) |
| ***F02B 53/00*** | (2006.01) |
| ***F01C 1/00*** | (2006.01) |
| ***F01C 3/02*** | (2006.01) |
| ***F01C 1/08*** | (2006.01) |
| ***F01C 1/24*** | (2006.01) |

(52) U.S. Cl. ..... 123/206; 123/228; 123/229; 123/233; 418/36; 418/195

(58) Field of Classification Search ..... 123/206, 123/228, 229, 233, 245; 418/34–38, 195–196
See application file for complete search history.

(56) References Cited

U.S. PATENT DOCUMENTS

| | | | | |
|---|---|---|---|---|
| 822,952 | A * | 6/1906 | Jewell | 418/195 |
| 1,013,885 | A * | 1/1912 | McConnell | 123/228 |
| 1,332,468 | A * | 3/1920 | Henig et al. | 418/195 |
| 1,704,254 | A * | 3/1929 | Jaffe | 123/229 |
| 1,720,098 | A * | 7/1929 | Shreffler et al. | 123/229 |
| 1,732,995 | A * | 10/1929 | Tschudi | 418/36 |
| 1,829,391 | A * | 10/1931 | Bullington | 123/245 |
| 2,676,576 | A * | 4/1954 | Fatoux | 418/195 |
| 2,760,466 | A * | 8/1956 | Black, Jr. | 123/228 |
| 3,277,832 | A * | 10/1966 | Marcel | 418/195 |
| 3,433,167 | A * | 3/1969 | Moodie | 418/195 |
| 4,013,046 | A * | 3/1977 | Kemp | 123/229 |
| 4,683,852 | A * | 8/1987 | Kypreos-Pantazis | 123/228 |
| 6,119,649 | A * | 9/2000 | Raab | 123/233 |
| 6,276,329 | B1 * | 8/2001 | Archer | 123/228 |
| 6,546,908 | B1 * | 4/2003 | Pekau | 123/206 |
| 7,059,294 | B2 * | 6/2006 | Wright | 123/233 |
| 2002/0162540 | A1 | 11/2002 | Matthews | 123/481 |

FOREIGN PATENT DOCUMENTS

| | | | |
|---|---|---|---|
| DE | 2827211 | A1 * | 1/1980 |
| DE | 10354621 | A1 * | 6/2005 |

* cited by examiner

*Primary Examiner*—Thai-Ba Trieu
(74) *Attorney, Agent, or Firm*—Ladas & Parry LLP

(57) ABSTRACT

A novel rotary engine of the kind having a toroidal cylinder and a set of pistons on a rotating circular piston assembly provides instantaneous adjustment of the displacement volume of the engine by varying the intake and expansion stroke length on the circular path of the pistons through the opening and closing of valves into the engine cylinder under the control of an engine management system responsive to the speed/load conditions of the engine and the throttle position.

9 Claims, 4 Drawing Sheets

TOROIDAL ENGINE WITH VARIABLE DISPLACEMENT VOLUME

BACKGROUND OF THE INVENTION

1. Filed of the Invention

The present invention relates to toroidal engines, toroidal compressors or toroidal generators wherein an assembly of pistons orbits continuously within a toroidal chamber about the central axis of the toroid. More particularly, the invention relates to improvements on engines and compressors, of this kind whereby the displacement volume of the engine or compressor may be selectively varied.

2. Description of the Prior Art

The conventional technology of internal combustion engines such as automobile engines is the reciprocating piston engine, in which a combination of connecting rod(s) and crank shaft is used to convert reciprocating motion of a piston into rotary motion.

It is currently widely recognized in industries such as transportation, that it would be highly desirable to produce internal combustion engines having variable displacement (sometimes referred to as "displacement on demand"). The ultimate objective is to improve fuel economy and reduce emissions in vehicles and equipment, without an unacceptable degree of sacrifice in performance and quick response.

A number of attempts have been made to achieve variable displacement in reciprocating piston engines. For the most part, these amount to the sequenced deactivation of several cylinders so that they do not consume any fuel and do not contribute to the power during low power operations. An example of a method and apparatus for deactivating and reactivating cylinders for an engine with displacement on demand is to be found in U.S. Patent Publication No. 2002/0162540 A1 (Mathews et al.).

Efficiency of cylinder deactivation as a route to achieving variable displacement in conventional reciprocating piston engines is hindered, since the deactivated pistons still have to be reciprocated (as a consequence of the crank shaft assembly), leading to friction. Further, the ignition and fuel injection of the deactivated cylinders have to be disengaged, making the control system still more complicated. Further still, the displacement can only be varied in certain steps, depending upon how many cylinders are deactivated. These are serious limitations and constraints upon variable displacement internal combustion engines.

As discussed in detail below, I have found that a toroidal piston engine, providing revolving pistons mounted to a central disk, is more easily adapted to selectively changing the displacement or size of the engine.

Like all positive displacement combustion engines, the toroidal engine must incorporate means both for compressing the intake charge and for containing the hot expanding gases that are generated by combustion. A number of attempts have been made to provide for some sort of on/off valving mechanism for the cylinder, to intercept the path of the advancing piston, then to retract and allow the piston to pass by, and thereafter to close behind the piston.

In the rotary engine described and claimed in my U.S. Pat. No. 6,546,908, a rotating disk valve perpendicular to the toroid includes a cutout portion which periodically traverses the toroidal chamber to allow passage of a piston does duty as the cylinder valving means. Compression occurs as a piston in the toroid approaches the disk valve, having earlier taken in fresh air from an inlet on the toroidal chamber. The disk valve and the piston form a closed part-toroidal chamber allowing compression as the advancing piston reduces the trapped air volume during the stroke. Most of the compressed air is then ducted into a combustion chamber, where fuel is injected and ignition takes place. While combustion takes place, the piston passes by the disk valve and the high pressure combustion gases are then ducted into the chamber behind the closing disk valve, pushing the piston forward as they expand, so producing rotation and power. Accordingly, each piston exposed to the expanding gases produces a power stroke.

U.S. Pat. No. 6,546,908 is hereby incorporated by reference for its teachings on the structure and operation of rotary engines and compressors generally. The principal objective attained by the toroidal engine which is the subject matter of this patent is to minimize residual volumes between the piston and the closed disk valve, through alterations to the geometry of the chamber section formed between valve and piston, and thereby to attain significant improvements in performance. For that reason, the engine of U.S. Pat. No. 6,546,908 was described as a "variable geometry" toroidal engine (VGT engine).

I have now developed a controlled air input and outlet valving system whereby variable displacement capability may be imparted to any toroidal internal and external combustion engine or toroidal compressor. Because toroidal engines do not employ the crank shaft/connecting rod/piston assembly of conventional reciprocating piston engines, there is no requirement for a complex and inefficient sequence of cylinder deactivation. I have discovered that stroke length variation in a toroidal engine incorporating the valving system of my invention may be achieved by the selective opening of intake port valves that determine when the compression stroke starts and exhaust port valves to determine when the expansion stroke (power stroke) has ended.

SUMMARY OF THE INVENTION

It is a principal object of the invention to provide a toroidal engine, generator or compressor having variable displacement volume capability to improve engine efficiency and fuel consumption over the full range of power operation levels of the engine or compressor.

It is a further object of the present invention to provide a toroidal piston engine, generator or compressor in which the displacement may be varied in continuous fashion over a predetermined range of displacement volumes.

With a view to achieving these objects, the present invention is directed to a rotary engine, generator or compressor and to rotary internal combustion engines in which the toroidal housing is provided with air charger and/or exhaust means employing selectively positionable openings into the toroidal piston chamber to achieve different desired compression and expansion stroke displacement volumes, that is, displacement on demand.

DETAILED DESCRIPTION OF PREFERRED EMBODIMENT

Figure 1A:
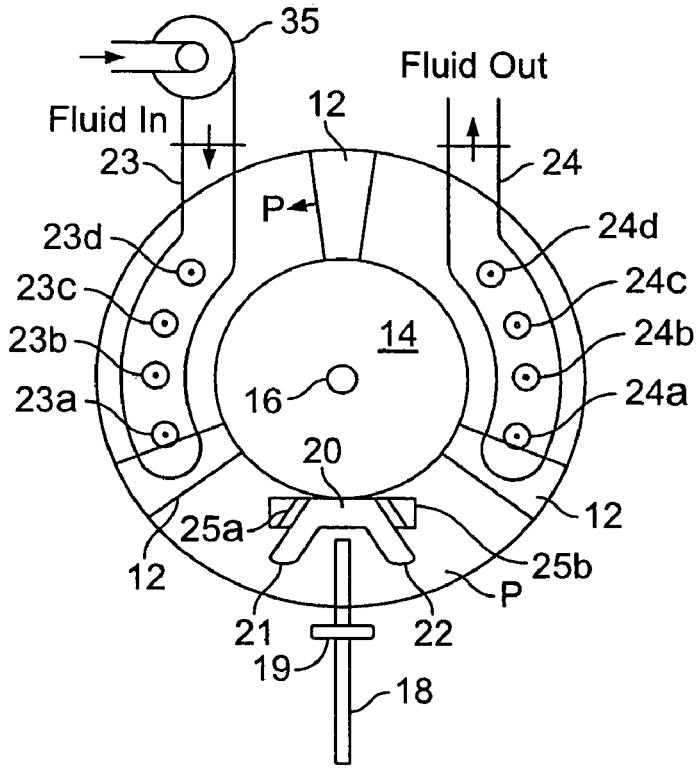
FIGS. 1A and 1B are schematic drawings in plan and in part sectional side elevational view, respectively, of the general arrangement of cylinder, pistons, combustion chamber and valves in an improved toroidal engine or compressor according to the present invention.
Figure 1B:
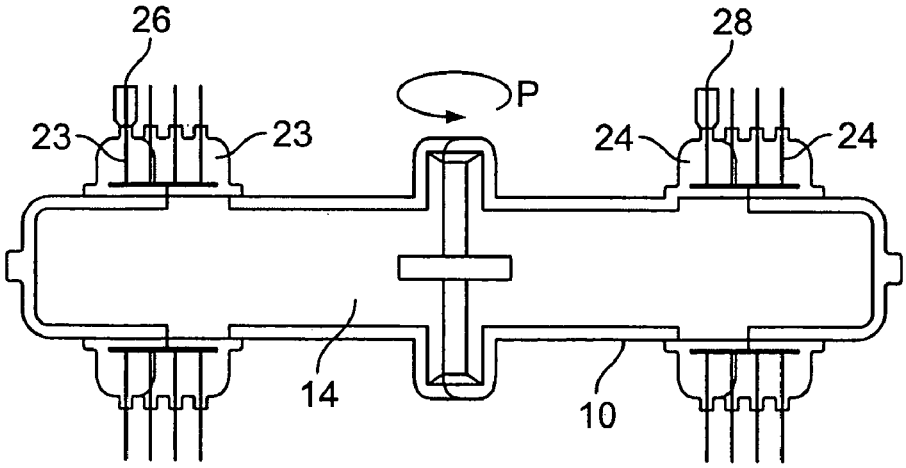

A toroidal engine of the general kind in which improvements may be incorporated according to the present invention comprises a toroidal chamber 10, within which several pistons 12 rotate in unison. Two, three (as illustrated in the drawing figures) or more pistons 12 are mounted circumferentially and equiangularly to a disk 14. Co-axially oriented with the axis of toroidal chamber 10 is a drive or output shaft 16 for delivery of torque developed by the motor.

Compression is generally achieved in toroidal engines, compressors and generators by the timed interception of the path of an advancing piston in the chamber by a blocking mechanism or a "valve" on the compression stroke, removal of the blocking means to allow the piston to travel past, then closing the blocking means again behind the advancing piston in the expansion stroke. In the embodiments illustrated herein, as for the VGT engine of my U.S. Pat. No. 6,546,908, compression is achieved by the timed intersection of toroidal chamber 10 with a rotating disk valve 18. Throughout the figures, the direction of motion of the pistons is indicated by arrows "P". The axis of rotation 19 of disk valve 18 is perpendicular to the central axis 16 of the rotating, piston-carrying disk 14.

As illustrated in FIG. 1A, the engine includes a bypass combustion chamber 20, where the majority of compressed air is stored and used in burning injected fuel, while a piston 12 bypasses the combustion chamber. Combustion chamber inlet port 21 and outlet port 22 serve respectively to allow compressed gases to enter the combustion chamber and to discharge gases from the chamber, either directly or through fast-opening and closing inlet and outlet valves (not illustrated) whose operation is synchronized to the location of a piston 12 on its circular pathway.

In known toroidal engines and compressors, including the VGT engine of my invention, air for combustion is forced in a continuous stream through an intake manifold 23 by a blower, turbocharger, or supercharger 35. According to the present improvements, a line of inlet ports 23*a* to 23*d* and a line of outlet ports 24*a* to 24*d* are symmetrically positioned along the upper half of toroidal housing 10. Optionally, a second set of valves might be installed on the lower half of the housing.

Air for combustion is fed to inlet ports 23*a* to 23*d* through an intake manifold 23 and post-compression gases are ducted away from outlet ports 24*a* to 24*d* via outlet manifold 24. The selective closing and opening of ports 23*a* to 24*d* is effected by valves actuated under the control of an engine management system (EMS), as described below. The valves may be controlled electronically, mechanically or manually for different applications, but with electronically operated EMS illustrated and described in connection with a toroidal automotive engine, solenoid-type valves are currently preferred. For simplicity, in FIGS. 2A, 2B and 2D only those of the four inlet and four outlet ports are shown which are actually opened during operation in the mode represented respectively by each of the drawing figures.

Figure 2A:
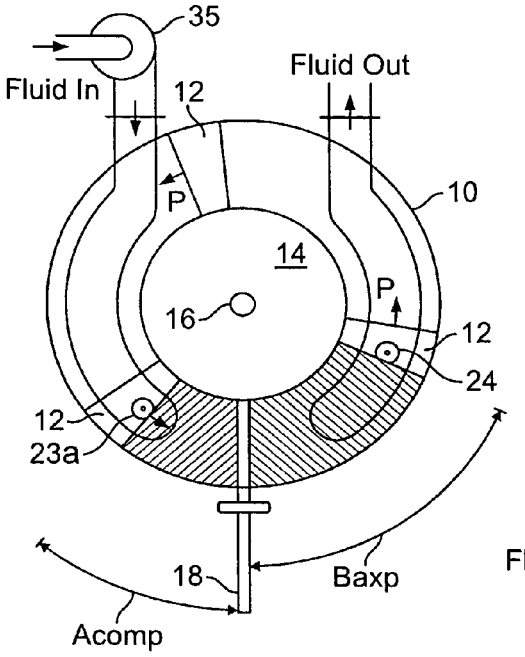
FIGS. 2A, 2B and 2C are schematic drawings of the improved toroidal engine of FIGS. 1A and 1B, illustrating how compression and expansion strokes are varied by the selective timed opening and closing of valves intake and outlet ports on the toroidal chamber.

FIG. 2A illustrates that when port 23*a* is the one opened by its valve, the compression stroke length is represented by sector $A_{comp}$. On the expansion side, if port 24*b* is opened by its associated valve, the expansion (power) stroke length is represented by the sector $B_{exp}$. It will be seen that the compression and expansion stroke lengths need not be set the same as each other. The cross-hatched areas represent the greater part of the "displacement", which is the difference between the total engine volume at the beginning of the compression stroke and the total engine volume immediately following compression, which has the dimension of volume, calculated by multiplying the stroke length times the cross-sectional piston area.

For a toroidal engine, as outlined in U.S. Pat. No. 6,546,908, the displacement consists total volume at beginning of compression minus total volume after compression is completed. The volume at beginning of compression consists of three components, namely, the volume in the toroid as indicated by the cross-hatched area plus the volume in the valves and valve assembly area plus the volume in the combustion chamber. The volume at the end of compression is the residual volume in the cross hatched area that is not compressed into the valve/valve assembly area and the combustion chamber, plus the volume in the valve/valve assembly are plus the volume in the combustion chamber.

Figure 2B:
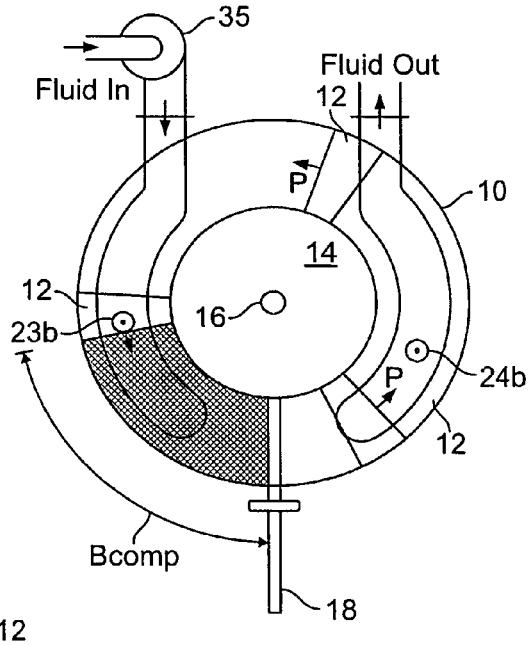

In FIG. 2B, a different inlet port 23*b*, further "upstream" than in FIG. 2A, i.e. in the direction opposite to the direction of piston rotation, is now opened by a solenoid valve while inlet ports 23*a*, 23*b* and 23*d* remain closed. This produces a longer compression stroke $B_{comp}$, thus producing a larger displacement during the compression stroke.

Figure 2C:
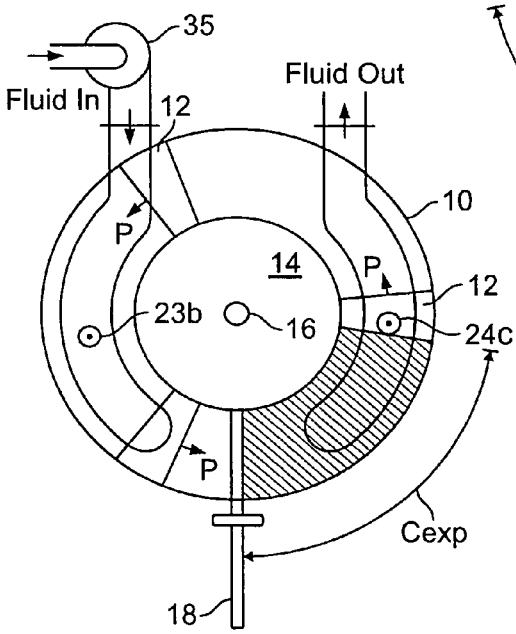

In FIG. 2C, a different outlet port 24*c* is opened by an associated valve and ports 24*a*, 24*b* and 24*d* remain closed. This yields a longer expansion (power) stroke, corresponding to sector $C_{exp}$ and hence a larger expansion displacement. Ports 23*b* and 24*c* can be operated independently and so compression and expansion stroke length can be made different from each other.

Referring now to FIG. 1A, it will be clear that a large displacement volume will result if valves 23*d* and 24*d* are open while valves [23*a*, 23*b*, 23*c*] and [24*a*, 24*b*, 24*c*] are closed. This produces a long compression stroke and a long expansion stroke, thereby increasing the swept volume of the pistons. It is advantageous to use a combustion chamber which is also variable in size. In combustion chamber 20, the effective chamber volume size is adjusted by means of movable combustion chamber counterpistons 25*a* and 25*b*. Taking the illustrated toroidal engine to be an automobile engine, a large displacement volume would be desirable where a large amount of power must be developed, e.g., where the vehicle is moving uphill carrying a trailer. In that instance, the combustion chamber 20 would also be maintained at a large volume.

For a small displacement volume, valves 23*a* and 23*b* are opened, with valves [23*a* and 24*a*, 23*c*, 23*d*] and [24*b*, 24*c*, 24*d*] closed. This produces a short compression stroke and a short expansion stroke, thereby decreasing the swept volume of the pistons 12. In this case, the combustion chamber will be reduced to a small volume by adjustment of counterpistons 25*a* and 25*b* to produce a small combustion chamber volume. A small displacement volume and accordingly reduced combustion chamber volume would be set when the power requirement is low, e.g. engine idling.

As noted above, these changes in valve opening selection and, optionally, movement of chamber counterpistons are achieved by valves 26, 28, etc. which are activated and controlled by the Engine Management System (EMS) in synchronization with the valve adjustment. Depending upon the application of the toroidal engine, compressor or generator, the "fluid in" and "fluid out" designations on the drawings can refer to a gas or a vapor. Fluid enters intake manifold 23 which communicates with all of the inlet ports and inlet valves. At the location "fluid out", the exhaust manifold 24 enters an exhaust pipe or turbocharger, in the case of an internal combustion engine, and the combustion gases escape following the expansion process. All exhaust ports and exhaust valves are connected to exhaust manifold 24.

As noted earlier the transfer ports 21 and 22 of combustion chamber 20 serve to allow the compressed gases to enter the combustion chamber, either directly or through a fast opening and closing inlet valve synchronized to the location of the pistons in the toroidal chamber. Similarly, the combustion gases are discharged either directly or through a timed, fast opening and closing exit valve.

Figure 3:
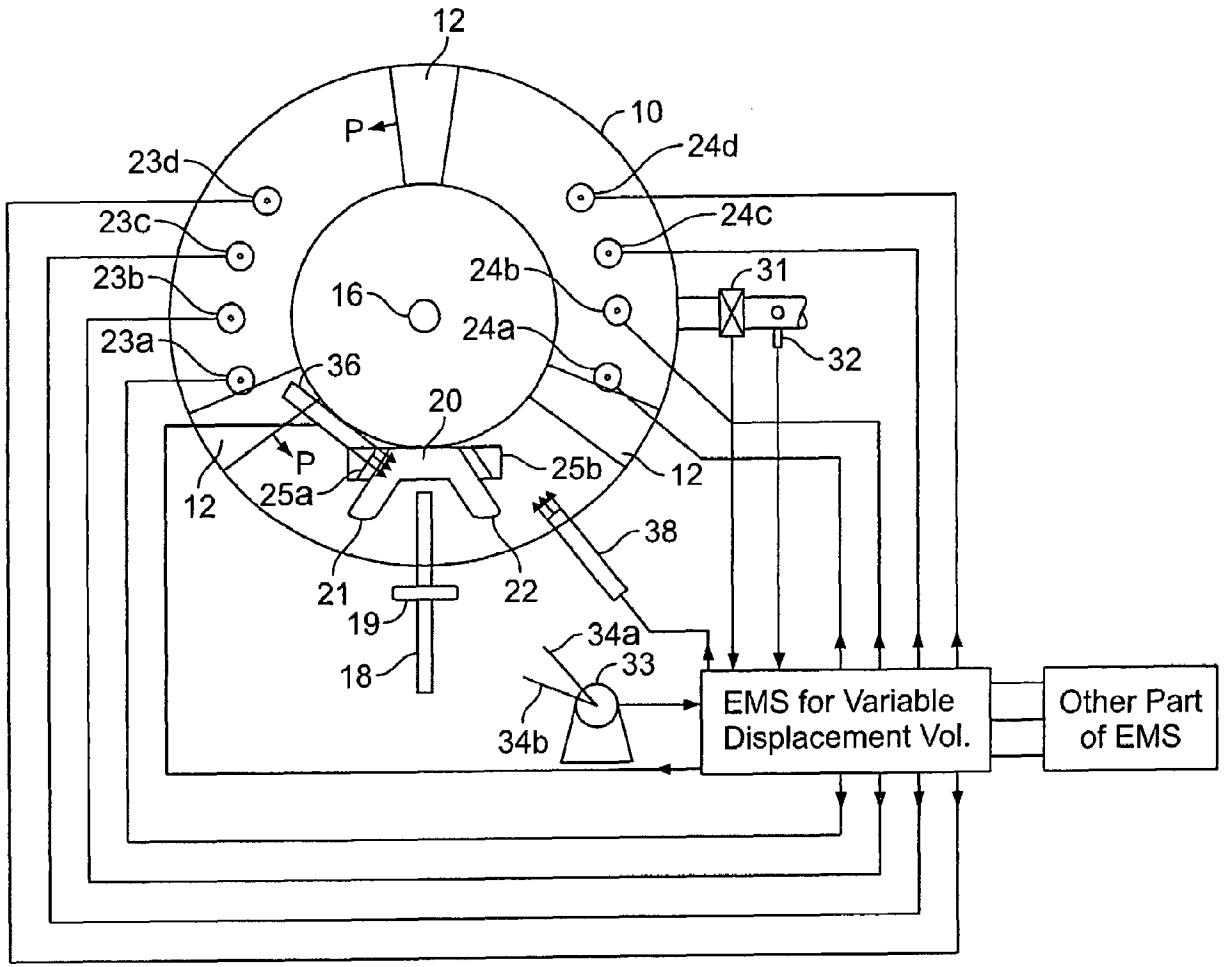
FIG. 3 schematically represents the use of electronic sequencing and control means (EMS) to automatically adjust the displacement volume according to power requirements in a toroidal automobile engine according to the present invention.

The Engine Management System is schematically illustrated in FIG. 3. The EMS is responsible for controlling and adjusting engine performance and operating characteristics, as well as minimizing emissions and optimizing the variable displacement volume system.

As indicated earlier, the variable displacement volume system adjusts displacement volume of the engine according to power requirements. The EMS monitors engine power requirements from a number of sensors, including a torque sensor 31, a speed (RPM) sensor 32 and throttle position sensor 33 which senses, for example, the angle of depression of an automobile accelerator pedal [34*a*, 34*b*]. On the basis of the signals produced by these and possibly other sensors, the EMS adjusts which of the intake and exhaust valves are to be opened or closed and how much fuel is to be injected into the toroidal cylinder of the internal combustion engine.

The EMS also controls adjustment of the size of the combustion chamber to obtain a desired compression ratio in synchronization with the opening and closing of the valves and the amount of the fuel injected into the chamber by injector 36. The adjustment of the valves 23*a*, 23*b*, . . . , 24*d* and the size of the combustion chamber 20 are carried out by activation of suitable EMS-controlled solenoids which operate the various valves and the movable counterpistons of the combustion chamber.

In addition to the primary injection of fuel into the combustion chamber by injector 36, a secondary injection in the toroidal chamber may optionally be implemented by fuel injector 38 which may be desirable, for example, where a short duration maximum power output is required.

Figure 4A:
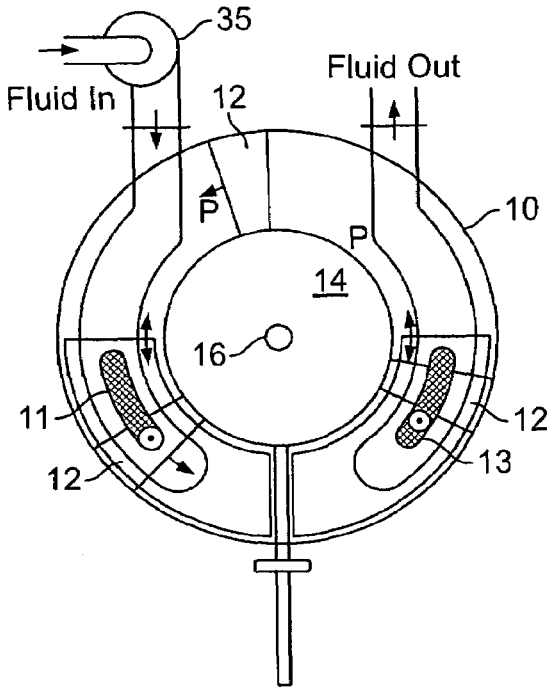
FIGS. 4A and 4B schematically illustrate an alternative valving arrangement for selective continuous variation of the compression and expansion strokes in a toroidal engine.
Figure 4B:
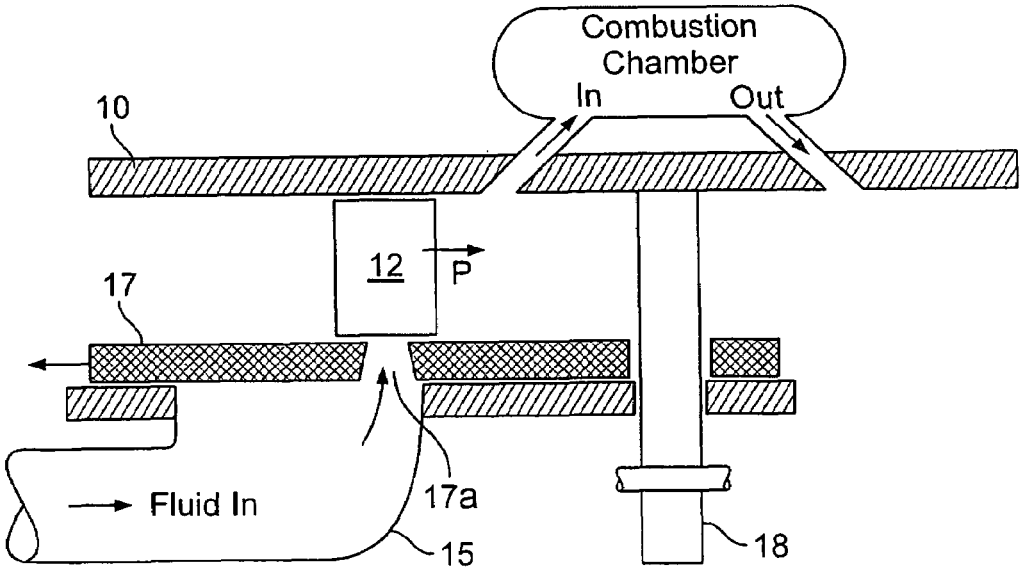

FIGS. 4A and 4B illustrate an arrangement, alternative to that of FIGS. 2A to 2C, whereby the compression and expansion stroke lengths may be varied essentially continuously rather than in stepwise fashion, by providing circular slot segments 11 for compression and 13 for expansion. Fluid is forced into the toroidal chamber through a conduit 15 connected to slot segment 11, by means of a blower, turbocharger or supercharger. A part-circular movable port plate 17 has an opening port 17*a* cut therethrough. As piston 12 is moved pass port 17*a* it begins to compress the fluid between the timing disk 18 and the piston 12, forcing the fluid into the combustion chamber 20 under pressure.

By moving port plate 17 to the left as viewed in FIG. 4B, (counter clockwise as seen in FIG. 4A), port 17*a* will give rise to a larger displacement, owning to the longer stroke length as soon as piston 12 covers the port and starts compression. By an entirely analogous arrangement, not shown, the expansion side in FIG. 4B is also provided with a conduit connected to a circular slot segment for varying the expansion displacement.

It is to be understood that the present invention is not limited to the embodiments described above but encompasses any and all embodiments and all suitable modifications and equivalents coming with the scope of the appended claims.

The invention claimed is:

1. A rotary engine or generator comprising, in combination:

a stationary toroidal piston cylinder with an interior chamber which is circular about a main axis of radial symmetry;

a piston assembly, comprising a circular mounting disk rotatable about said main axis and at least one piston fixedly mounted to the periphery of said disk for motion in a circular path through the chamber of said toroidal piston cylinder;

a central shaft extending from the center of said mounting disk, coaxial with said main axis for transmission of energy from the engine;

timed on/off valving means which, in use, periodically open within the chamber to permit a passage of said at least one piston therethrough and then close the passage sealingly, forming an expansion chamber between the closed valving means and said at least one piston receding;

control means for actuating said on/off valving means in preselected synchronization with the rotation of said central shaft and said piston assembly;

an air blower for injecting said pressurized fluid into said expansion chamber to impart thrust to said piston in a power stroke; and exhaust means for venting fluid from the cylinder, following said power stroke, from a selected downstream position on the cylinder intermediate said on/off valving means and said at least one piston receding, each said position corresponding to a selected expansion stroke length and expansion displacement volume, wherein said exhaust means comprises an exhaust manifold in communication with a second plurality of ports opening into said cylinder at said selected downstream locations, each of said ports being provided with independently operable valves for selectively opening one of said valves and closing the others for a predetermined expansion displacement volume.

2. A rotary internal combustion engine according to claim 1, wherein said independently operable valves are electronically controlled solenoid valves.

3. A rotary internal combustion engine according to claim 2, further comprising engine displacement control means, including sensors to produce signals indicative of the operating conditions of the engine and electronic sequencing means, responsive to said signals, for opening and closing said solenoid valves to optimize the displacement volumes for the engine operating conditions.

4. A rotary internal combustion engine according to claim 3, including means for adjusting the volume of said combustion chamber, operable in response to signals from said electronic sequencing means to optimize the combustion chamber volume for the engine operating conditions.

5. A rotary internal combustion engine of claim 1, wherein said timed on/off valving means comprises a rotating disk valve perpendicularly intersecting said toroidal piston cylinder, Including a cutout section which, in use, periodically opens within the cylinder chamber as the disk valve rotates to permit a passage of said at least one piston therethrough and then close the passage sealingly.

6. A rotary internal combustion engine comprising, in combination:

a stationary toroidal piston cylinder with an interior chamber which is circular about a main axis of radial symmetry;

a piston assembly, comprising a circular mounting disk rotatable about said main axis and at least one piston fixedly mounted to the periphery of said disk for motion of said at least one piston in a circular path within said toroidal piston cylinder;

a central shaft extending from the center of said mounting disk, coaxial with said main axis for transmission of energy from the engine;

timed on/off valving means which, in use, periodically open within the chamber to permit passage of said at least one piston therethrough and then close the passage sealingly, forming a compression chamber between the closed valving means and an approaching piston, and an expansion chamber between the closed valving means and said at least one piston receding;

control means for actuating said on/off valving means in preselected synchronization with the rotation of said central shaft and piston assembly;

an engine ignition system, including a by-pass combustion chamber, a fuel injection system, an inlet valve operable to receive air from said compression chamber in a compression stroke or combustion of the fuel-air mixture and an outlet valve for injecting a high velocity jet of the burning air-fuel mixture into said expansion chamber to impart thrust to said piston in a power stroke;

air charger means for injecting air for combustion into the cylinder at a selected one of upstream locations on the cylinder, intermediate an advancing piston and said timed on/off valve means for said compression stroke, each of said upstream locations corresponding to a selected compression stroke length and compression displacement volume; and exhaust means for venting combustion exhaust from the cylinder following said power stroke at a selected one of downstream locations on the cylinder, intermediate said on/off valving means and said at least one piston receding, each of said downstream locations corresponding to a selected expansion stroke length and expansion displacement, wherein said air charger means comprises an air blower, an air intake manifold in communication with said air blower and with a first plurality of ports opening into said cylinder at said selected upstream locations, each of said ports being provided with independently operable valves for selectively opening one of said valves and closing the others for a predetermined compression displacement volume.

7. A rotary internal combustion engine of claim 6 wherein said timed on/off valving means comprises a rotating disk valve perpendicularly intersecting said toroidal piston cylinder, including a cutout section which, in use, periodically opens within the cylinder chamber as the disk valve rotates to permit a passage of said at least one piston therethrough and then close the passage sealingly.

8. A rotary internal combustion engine comprising, in combination:

a stationary toroidal piston cylinder with an interior chamber which is circular about a main axis of radial symmetry;

a piston assembly, comprising a circular mounting disk rotatable about said main axis and at least one piston fixedly mounted to the periphery of said disk for motion of said at least one piston in a circular path within said toroidal piston cylinder;

a central shaft extending from the center of said mounting disk, coaxial with said main axis for transmission of energy from the engine;

timed on/off valving means which, in use, periodically open within the chamber to permit passage of said at least one piston therethrough and then close the passage sealingly, forming a compression chamber between the closed valving means and an approaching piston, and an expansion chamber between the closed valving means and said at least one piston receding;

control means for actuating said on/off valving means in preselected synchronization with the rotation of said central shaft and piston assembly;

an engine ignition system, including a by-pass combustion chamber, a fuel injection system, an inlet valve operable to receive air from said compression chamber in a compression stroke or combustion of the fuel-air mixture and an outlet valve for injecting a high velocity jet of the burning air-fuel mixture into said expansion chamber to impart thrust to said piston in a power stroke;

air charger means for injecting air for combustion into the cylinder at a selected one of upstream locations on the cylinder, intermediate an advancing piston and said timed on/off valve means for said compression stroke, each of said upstream locations corresponding to a selected compression stroke length and compression displacement volume; and exhaust means for venting combustion exhaust from the cylinder following said power stroke at a selected one of downstream locations on the cylinder, intermediate said on/off valving means and said at least one piston receding, each of said downstream locations corresponding to a selected expansion stroke length and expansion displacement volume, wherein said air charger means comprises an air blower, an air intake manifold in communication with said air blower at a first end thereof, an arcuate slot opening into the cylinder chamber upstream of the engine ignition system and a plate having a port therethrough, said plate being continuously movable along said slot to prevent the intake of air from said intake manifold into the toroidal chamber except at the location of said port, corresponding to a predetermined compression displacement volume.

9. A rotary intemal combustion engine according to claim 8, wherein said exhaust means comprises an exhaust manifold, an arcuate slot opening into the cylinder chamber downstream of the engine ignition system and a plate having a port therethrough, said plate being continuously movable along said slot to prevent the venting of the combustion exhaust from the cylinder except at the location of said port, corresponding to a predetermined expansion displacement volume.

* * * * *